United States Patent [19]

Iwata et al.

[11] Patent Number: 4,702,742

[45] Date of Patent: Oct. 27, 1987

[54] AQUEOUS JET-INK PRINTING ON TEXTILE FABRIC PRE-TREATED WITH POLYMERIC ACCEPTOR

[75] Inventors: Kazuo Iwata; Shoji Koike, both of Yokohama, Japan

[73] Assignee: Canon Kabushiki Kaisha, Tokyo, Japan

[21] Appl. No.: 804,107

[22] Filed: Dec. 3, 1985

[30] Foreign Application Priority Data

| | | | |
|---|---|---|---|
| Dec. 10, 1984 | [JP] | Japan | 59-259247 |
| Dec. 10, 1984 | [JP] | Japan | 59-259248 |
| Dec. 10, 1984 | [JP] | Japan | 59-259249 |
| Dec. 10, 1984 | [JP] | Japan | 59-259250 |

[51] Int. Cl.[4] ..... D06B 1/02; D06P 1/52; B41J 3/04

[52] U.S. Cl. ..... 8/495; 8/529; 8/552; 8/553; 8/555; 8/558; 8/561; 8/563; 8/917; 8/918; 8/924; 8/927; 106/20; 106/22

[58] Field of Search ..... 8/552, 495

[56] References Cited

U.S. PATENT DOCUMENTS 4,441,884 4/1984 Baumann et al. ..... 8/542

FOREIGN PATENT DOCUMENTS 1532036 6/1976 United Kingdom .

*Primary Examiner*—A. Lionel Clingman

*Attorney, Agent, or Firm*—Fitzpatrick, Cella, Harper & Scinto

[57] ABSTRACT

A method for textile printing is provided which comprises a step (X) of depositing an aqueous ink containing a dye on cloth by an ink jet process and, optionally a step (Y) of fixing the dye, the step (X) being carried out after depositing an acceptor for the ink on the cloth. The dye may be a disperse dye, and the cloth may comprise synthetic and/or semi-synthetic fibers as a main component.

15 Claims, No Drawings

AQUEOUS JET-INK PRINTING ON TEXTILE FABRIC PRE-TREATED WITH POLYMERIC ACCEPTOR

BACKGROUND OF THE INVENTION

1. Field of the Invention

This invention relates to a method for textile printing by ink jet process, and more particularly to a method for textile printing by ink jet process, characterized by using specific, pretreated cloth.

2. Description of the Prior Art

In the printing of cloth such as woven or non-woven fabrics of various fibers or mix-spun fabric, various printing methods such as roller printing, screen printing, transfer printing, etc. have been so far employed, and further a method for textile printing by ink jet process has been proposed for certain uses.

These conventional, ordinary methods for textile printing require print plates and the preparation of these plates such as plate drums or screen plates are expensive or even in the transfer printing the preparation of plates for printing transfer paper is also expensive, so that the preparation does not pay from the viewpoint of cost, unless the plates are produced in a large quantity. Furthermore, the period of fashion of print cloth patterns is generally so short that the preparation of the plates at each occasion of change in fashion leads to a further cost increase, resulting in a failure to rapidly meet the fashion tendency, and this will lead to a high possibility of stockpiles of an enormous amount of out-of-date prints.

To overcome these disadvantages, textile printing by an ink jet process has been proposed. However, in the textile printing by ink jet process, a recording liquid (ink) of high viscosity such as the conventional printing paste cannot be employed, and in the case of printing woven fabrics, etc., the ink retainability of the surface of woven fabric is poor, and also owing to the presence of texture, the deposited ink is liable to spread, so that it is difficult to form a precise print pattern. Furthermore, even if fixing of the deposited dye is effected after the printing, neither distinguished levelling property nor high fixation efficiency of the dye on the surface of woven fabric has been obtained.

SUMMARY OF THE INVENTION

An object of the present invention is to provide a method for textile printing by ink jet process which can solve the economical problem in the conventional, ordinary methods for textile printing, the problem that no precise print can be obtained in the method for textile printing by ink jet process, and the problem that the fixation efficiency of the deposited dye is low on the surface of woven fabric, as described above, at the same time.

According to an aspect of the present invention, there is provided a method for textile printing, which comprises a step (X) of depositing an aqueous ink containing a dye on cloth by an ink jet process and, optionally a step (Y) of fixing the dye, the step (X) being carried out after depositing an acceptor for the ink on the cloth.

According to another aspect of the present invention, there is provided a method for textile printing which comprises a step (X') of depositing an aqueous ink containing a dye on cloth by an ink jet process, and, optionally a step (Y') of fixing the dye, the dye being a disperse dye, the cloth comprising synthetic and/or semi-synthetic fibers as a main component, and the step (X') being carried out after depositing an acceptor for the ink onto the cloth.

DETAILED DESCRIPTION OF PREFERRED EMBODIMENTS

The main feature of the present invention resides in a method for textile printing by ink jet process, which comprises depositing an acceptor for ink onto the surface of cloth or its constituent fibers as a material to be printed, the acceptor being capable of easily and rapidly absorbing and accepting the ink as a recording liquid of ink jet process, and then depositing a jet ink thereon.

The cloth for use in the present invention which mainly characterizes the present invention includes cloth made of fibers dyeable with a water-soluble dye such as natural fibers, for example, cotton, wool, silk, hemp, etc.; regenerated fibers, for example, cupra, rayon, etc.; synthetic fibers, for example, acryl, nylon, etc., or mix-spun cloth of these different fibers or these fibers with other fibers, such as fibers of polyester, vinylon, polypropylene, acetate, triacetate, etc. In the present invention, the cloth or fibers constituting the cloth is pretreated so as to rapidly and easily absorb and accept an ink for the ink jet process.

The present inventors have found that the said disadvantages of the prior art, particularly the problem encntered when an ink of low viscosity for the ink jet process can be easily solved by providing an ink acceptor having the said property on cloth as a material to be printed, and have established the present invention.

Preferable material for the acceptor includes water-soluble or hydrophilic natural or synthetic polymers, and preferable examples are natural compounds and their modified products or their derivatives by chemical reaction, such as wheat flour rice powder, rice bran, funorin, albumin, gelatin, casein, starch, cellulose, gum arbic, tragacanth gum, locust bean gum, sodium alginate, bentonite, etc. and synthetic resins and their modified products or their derivatives such as water-soluble polyamide, polyacrylamide, quaternarized polyvinylpyrrolidone, polyethyleneimine, polyvinyl-pyridinium halide, melamine resin, polyurethane, polyvinyl alcohol, water-soluble polyester, sodium polyacrylate, etc., and at last one of these materials is used as required. Furthermore, to reinforce the strength of the ink acceptor and/or to improve the adhesion of the ink acceptor to a substrate, it is possible to use a resin as a binder such as SBR latex, NBR latex polyvinylformal, polymethyl methacrylate, polyvinylbutyral, polyacrylonitrile, polyvinyl chloride, polyvinyl acetate, phenol resin, alkyd resin, etc., if required.

The ink acceptor is deposited on the cloth by dissolving or dispersing the said polymer individually or their mixture in an appropriate solvent, thereby preparing a treating the liquid, and treating cloth or fibers constituting the cloth with the treating liquid according to the known process, for example, by dipping, spraying, roll coating, rod-bar coating, air knife coating or the like. The treatment can be carried out on the arns or fibers before weaving (the treated yarns or fibers are woven thereafter) or on woven cloth. The treatment can be carried out in advance of the printing or just before the printing.

The thickness of the ink acceptor coating film thus formed must be in such a range as to accept the ink, and is desirably at least 0.1 μm, though dependent on the quantity of the ink to be deposited, and practically is in a range of 0.5 to 30 μm.

When the thickness exceeds 30 m, the fixation efficiency of the dye in the dye-fixing step is deteriorated, an the dye-fixing time is prolonged, resulting in a cost increase. When the thickness is less than 0.5 μm on the other hand, formation of precise print patern or an increase in the fixation efficiency of the dye cannot be attained. The adjustment of thickness can be easily carried out by controlling a polymer concentration in the treating liquid in the step of forming the ink acceptor coating film.

When the ink acceptor is deposited on the surface of cloth or fibers constituting the cloth, then the ink is deposited on the cloth by ink jet process. The deposited ink is absorbed and accepted by the ink acceptor within 3 minutes, and thus the ink dots will not excessively spread on the cloth. Thus, precise pinting and a high fixation efficiency of the dye can be attained in the successive dye-fixing treatment. Furthermore, since the deposited ink can be absorbed and accepted within such a short time, there will be no staining of other material, even if brought into contact with the printed surface, and the printed cloth can be laid one upon another or wound up immediaetly after the printing, and thus can be preserved in any form till the successive dye-fixing treatment On the other hand, when cloth without any coating of the ink acceptor is used as cloth to be printed, the applied ink dots are excessively spread, because the ink or ink jet process is usually an aqueous solution of low viscosity, whereas various fibers constituting cloth are not always completely hydrophilic, for example, fibers of nylon, wool, silk, cotton, etc. and also owing to the presence of texture of cloth. Thus it is difficult to form a precise pattern. Furthermore the fixation efficiency of the dye is loww in the dye-fixing step. Even if cloth is relatively hydrophilic such as cotton, it is not always so hygroscopic as to absorb the ink within a short time, for example, within 3 minutes, and transfer the ink to other material, even if brought in contact with the printed surface. Other fibers than the cotton fibers are poor in the hygroscopic property, and their handling, such as winding, immediately after the printing is quite difficult to conduct. These problems of the prior art has been copletely solved in the present invention.

As to the dye for the ink for ink jet process to be used in the present invention, any of the so far known dyes can be used, but it is preferable to select it in view of the species of fibers constituting the cloth as a material to be printed. For example, in the case of cellulose-based fibers such as cotton, hemp, viscose, etc., direct dyes, reactive dyes, sulfur dyes in the reduced form, naphthol dyes, vat dyes in the reduced form, soluble vat dyes, etc. can be used. Particulrly preferable are direct dyes such as C.I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161, 163; C.I. Direct Orange 6, 15, 18, 26, 29, 34, 37, 39, 40, 41, 46, 49, 51, 57, 62, 71, 105, 107, 115; C.I. Direct Red 2, 4, 9, 23, 26, 31, 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243, 247; C.I. Direct Violet 7, 9, 47, 48, 51, 66, 90, 93, 94, 95, 98, 100, 101; C.I. Direct Blue 1, 10, 15, 22, 25, 55, 67, 68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289, 291; C.I. Direct Green 26, 27, 28, 29, 30, 31, 33, 34, 59, 63, 65, 66, 67, 68, 74, 80, 85, 89; C.I. Direct Brown 44, 98, 100, 103, 106, 113, 115, 116, 157, 169, 170, 172, 195, 200, 209, 210, 212, 221, 222, 223, 227, 228, 229; C.I. Direct Black 9, 17, 19, 22, 32, 51, 56, 62, 69, 77, 80, 91, 94, 97, 108, 112, 113, 114, 117, 118, 111, 122, 1 25, 132, 146, 154, 166, 173, 199; Kaycelon Red C-HB, Kayacelon Rubin C-BL; Kayacelon Blue C-G, etc.; and reactive dyes such as C.I. Reactive ellow 2, 3, 13, 14, 15, 17, 18, 23, 24, 25, 26, 27, 29, 35, 37, 41, 42, 49, 50, 52, 54, 55, 57, 58, 63, 64. 75, 76, 77, 79, 81, 82, 83, 84, 85, 87, 88, 91, 92, 93, 95, 96, 111, 115, 116, 131, 135; C.I. Reactve Orange 5, 7, 10, 11, 12, 13, 15, 16, 20, 30, 34, 35, 41, 42, 44, 45, 46, 56, 57, 62, 63, 64, 67, 69, 71, 72, 73, 74, 78, 82, 84, 87; C.I. Reactive Red 3, 13, 17, 19, 21, 22, 23, 24, 29, 35, 37, 40, 41, 43, 45, 49, 55, 56, 58, 63, 67, 80, 81, 82, 85, 86. 87, 104, 106, 108, 109, 110, 111, 112, 113, 114, 117, 118, 119, 120, 123, 124, 126, 128, 130, 131, 132, 141, 147, 158, 159, 170, 171, 174, 176; C.I. Reactive Violet 1, 3, 4, 5, 6, 7, 8, 9, 16, 17, 22, 23, 24 26, 27, 33; C.I. Reactive Blue 2, 3, 5, 8, 10, 13, 14, 15, 17, 18, 19, 21, 25, 26, 27, 28, 29, 38, 39, 40, 42, 43, 49, 51, 52, 65, 66, 67, 68, 71, 73, 74, ;5, 77, 78, 79, 80, 89, 98, 100, 101, 104, 105, 112 113, 114, 116, 119, 147, 148, 158, 160, 162, 169, 170, 171, 179, 182, 187; C.I. Reactive Green 5,8, 12, 14, 15, 16, 19, 21; C.I. Reactive Brown 2, 5, 6, 7, 8, 9, 16, 17, 18, 19, 21, 24, 26, 30; C.I. Reactive Black 4, 5, 8, 14, 21, 23, 26, 31, 32, 34; and the individual dyes in Kayacelon React series (Nihon Kayaku K.K., Japa). Onto mix-spun fabrics of cotton with other fibers are deposited the same dyes as described above.

When the fibers are of protein such as wool, silk, nylon, etc. or of polyamide, acid dyes, chrome dyes (acid mordant dyes), reactive dyes, soluble vat dyes, sulfur dyes in the reduced form, naphthol dyes, etc. can be employed. Particularly preferable are acid dyes such as C.I. Acid Yellow 17, 19, 25, 39, 40, 42, 44, 49, 50, 61, 64, 76, 79, 110, 127, 135, 143, 151, 159, 169, 174, 190, 195, 196, 197, 199, 218, 219, 222, 227; C.I. Acid Orange 3, 19, 24, 28:1, 33, 43, 45, 47, 51, 67, 94, 116, 127, 138, 145, 156; C.I. Acid Red 35, 42, 57, 62, 80, 82, 111, 114, 118, 119, 127, 128, 131, 143, 151, 154, 158, 249, 257, 261, 263, 266, 299, 301, 336, 337, 361, 396, 397; C.I. Acid Violet 5, 34, 43, 47, 48, 90, 103, 126; C.I. Acid Blue 25, 40, 41, 62, 72, 76, 78, 80, 82, 92, 106, 112, 113, 120, 127:1, 129, 138, 143, 175, 181, 205, 207, 220, 221, 230, 232, 247, 258, 260, 264, 271, 277, 278, 279, 280, 288, 290, 326; C.I. Acid Green 16, 17, 19. 20, 25, 28, 40, 41, 71; C.I. Acid Brown 4, 248; C.I. Acid Black 7, 24, 29, 48, 52:1, 172, etc. acid reactive dyes such as C.I. Reactive Yellow 21, 34, 39, 69, 98, 125, 127; C.I. Reactive Orange 29, 53, 68; C.I. Reactive Red 28, 65, 66, 78, 83, 84, 100, 116, 136, 147, 154, 172; C.I. Reactive Violet 34; C.I. Reactive Blue 50, 69, 94, 177; C.I Reactive Brown 12, etc. When the fibers are of acryl, it is preferable to use basic dyes such as C.I. Basic Yellow 1, 2, 4, 11, 13, 14, 15, 19, 21, 23, 24, 25, 28, 29, 32, 36, 39, 40, 45, 49, 51, 56, 61, 63, 67, 70, 71, 73, 77, 82, 85, 87, 91, 92; C.I. Basic Orange 21, 22, 27, 28, 29, 30, 36, 40, 42, 43, 44, 46, 47, 57, 58; C.I. Basic Red 12, 13, 14, 15, 18, 22, 23, 24, 25, 27, 29, 35, 36, 38, 39, 45, 46, 51, 52, 54, 59, 60, 61, 68, 69, 71, 74, 75, 78, 80, 81, 82, 95, 100, 102, 103, 104, 109; C.I. Basic Violet 1, 2, 3, 7, 10, 15, 16, 20, 21, 25, 27, 28, 35, 37, 9, 40, 48; C.I. Basic Blue 1, 3, 5, 7, 9, 22, 26, 41, 45, 46, 47, 54, 57, 60, 62, 65, 66, 69, 116, 117 120, 122, 124, 137, 141; C.I. Basic Green 1, 4, 6, 8, 9; C.I. Basic Brown 14; C.I. Basic Black 8, etc.

When the cloth to be printed comprises synthetic fibers and/or semi-synthetic fibers as the main component, it is preferable to use disperse dyes as a dye for the ink. So far known disperse dye can be employed, but particularly preferable are C.I. Disperse Yellow 5, 42, 56, 64, 76, 79, 83, 100, 124, 140, 160, 162, 163, 164, 165, 186, 192, 224; C.I. Disperse Orange 13, 29, 30, 31, 33, 43, 49, 50, 55, 61, 73, 78, 119; C.I. Disperse Red 43, 54, 56, 72, 73, 76, 88, 91, 92, 93, 103, 111, 113, 126, 127, 128, 135, 143, 145, 152, 153, 154, 164, 181, 188, 189, 192, 203, 205, 206, 207, 221, 224, 225, 227, 257, 258 288, 296; C.I. Disperse Violet 27, 35, 38, 46, 52, 56; C.I. Disperse Brown 1, 9; C.I. Disperse Blue 54, 60, 73, 87, 94, 113, 128, 139, 142, 143, 146, 148 149, 158, 167, 176, 183, 186, 187, 197, 198, 201 205, 207, 211, 214, 224, 225, 257, 259, 267, 268 270, 301; Kayacelon Red E-GL, Kayacelon Blue E-TB, etc.

When the cloth to be printed is a mix-spun fabric or other fibers such as cotton, silk, hemp, wool or ther natural fibers, dyes for these natural fibers, such as direct dyes, acid dyes, chrome dyes (acid mordant dyes), reactive dyes, vat dyes in the reduced form, soluble vat dyes, sulfur dyes in the reduced form, naphthol dies, etc. can be employed together with the disperse dye.

The ink for the ink jet process for use in the present invention can be prepared by dissolving or dispersing the dye as mentioned above in a medium to a concentration of about 0.1 to about 15% by weight. The ink medium is water alone, or preferably a mixture of water, and a water-soluble organic solvent. The organic solvent for use in the present invention includes alkyl alcohols having 1 to 4 carbon atoms such as methyl alcohol, ethyl alcohol, n-propyl alcohol, isopropyl alcohol, n-butyl alcohol, sec-butyl alcohol, tert-butyl alcohol, isobutyl alcohol, etc.; amides such as dimethyl formamide, dimethyl acetamide, etc.; ketones or ketoalcohols such as acetone, diacetone alcohol, etc.; ethers such as tetrahydrofuran, dioxiane, etc.; polyalkylene glycols such as polyethylene glycol polypropylene glycol, etc.; alkylene glycols with an alkylene group having 2 to 6 carbon atoms, such as ethylene glycol, propylene glycol, butylene glycol, triethylene glycol, 1,2,6-hexanetriol, thiodiglycol, hexylene glycol, diethylene glycol, etc.; glycerine; lower alkyl ethers of polyhydric alcohol such as ethylene glycol methyl (or ethyl) ether, diethylene glycol methyl (or ethyl) ether, triethylene glycol monomethyl (or ethyl) ether, etc.; N-methyl-2-pyrrolidone, 1,3,-dimethyl-2-imidazolidinone, etc.

The said medium can be used individually or in a mixture, but the most preferable medium composition comprises water and at least one of water-soluble organic solvent, and the water-soluble solvent contains at least one of water-soluble, high boiling organic solvents, for example, polyhydric alcohols such as ethylene glycol, propylene glycol, glycerine, etc. The medium is used so that the content of the said dye may be about 0.1 to about 15% by weight, when the ink composition is prepared.

An ink containing a disperse dye can be generally prepared by mixing the essential components and optional components as described above, subjecting the mixture to mixing-milling treatment by well known means such as a ball mill, sand mill, speed line mill, etc., if necessary, adjusting the concentration with a medium, and adjusting the pH finally to 4–10. The particle size of the disperse dye is usually not more than about 30 μm, preferably not more than about 20 μm. When the particle size is too large, there will be problems of nozzle clogging, etc. during the ink jet recording, or in the levelling property in the successive dye-fixing step. When a medium capable of dissolving a disperse dye is selected, the present ink composition can be obtained only by utilizing mere dissolving action, such as heating, etc.

The essential components for the ink composition to be used in the present invention are as described above, but various known dispersants, surfactants, viscosity-controlling agents, etc. can be added thereto, if required.

Important dispersant or surfactant to be added to the essential components, if required, are anionic dispersants or surfactants such as fatty acid salts, alkyl sulfate ester salt, alkylbenzene sulfonate salt, alkylnaphthalene sulfonate salt, dialkyl sulfosuccinate salt, alkyl phosphate ester salt, naphthalene sulfonate-formalin condensate, polyoxyethylenealkyl sulfate ester salt, etc.; nonionic dispersants or surfactants such as polyoxyethylenealkyl ether, polyoxyethylenealkylphenyl ether, polyoxyethylene fatty acid ester, sorbitane fatty acid ester, polyoxyethylene sorbitane fatty acid ester, polyoxyethylenealkylamine, glycerine fatty acid ester, oxyethyleneoxypropylene block copolymer, etc.

Preferable viscosity-controlling agent includes natural or synthetic water-soluble polymers such as carboxymethylcellulose, sodium polyacrylate, polyvinylpyrrolidone, gum arabic, starch, etc. The viscosity of the present ink composition is adjusted to not more than 50 cps, preferably 1 to 10 cps at 25° C. with or without the viscosity-controlling agent.

Beside the foregoing three additives, for example, a defoaming agent, a permeating agent, antiseptics, a pH-controlling agent, etc. can be added thereto, if required.

Futhermore, a resistivity-controlling agent such as lithium chloride, ammonium chloride, or sodium chloride is added thereto to prepare an ink for the ink jet recording process of ink-electrocharging type. When an ink is applied to an ink jet process of ejecting an ink under the action of thermal energy, thermal physical properties (e.g. specific heat, coefficient of thermal expansion, thermal conductivity, etc.) must be adjusted.

Any ink jet recording process can be used in the present invention, so far as it can effectively release the ink composition from the nozzle and deposite the ink onto cloth to be printed. Typical of the process are those disclosed, for example, in IEEE Transactions on Industry Applications Vol. JA-13, No. 1, (February and March issues, 1977) and Nikkei Electronics No. 305 (Dec. 16 issue, 1982). The processes disclosed therein are suitable for the present method for textile printing, some of which will be described below.

A first process is an electrostatic attraction process including a system of successively discharging from a nozzle an ink as changed into particulates under a strong electric field given between the nozzle and an accelerating electrode provided a few mm before the nozzle and giving an information signal to deviating electrodes while the discharged ink composition is flying between the deviating electrodes, thereby conducting recording, and also including a system of injecting ink particulates in accordance with an information signal without deviating the ink particulates. Any of these systems is effective for the present method for textile printing.

A second process is to give a high pressure to an ink by a small pump and injecting fine ink particles forcely while mechanically vibrating the nozzle by a quartz oscillator, where the injected ink particles are electrically charged in accordance with an information signal at the same time when injected, and the electrically charged ink particles are deviated in accordance with the quantity of charged electricity during the passage between the deviating electrodes. Another process utilizing the said process is the one called "microdot ink jet process, where two kinds of ink droplets, i.e. larger droplets and smaller droplets, are generated at the tip end of nozzle by keeping the ink pressure and exciting conditions in appropriate ranges, respectively, and only smaller droplets are utilized for recording. This process can characteristically produce groups of fine droplets even through a nozzle having a large diameter such as the conventional nozzle.

A third process is a process using a piezo device, where a piezo device is used as a pressurizing means for the ink in place of the mechanical means such as a pump in other processes. An ink is injected while giving the ink a pressure generated by giving an electric signal to the piezo device, thereby causing a mechanical displacement.

Furthermore, an ink jet process disclosed in Japanese patent application Kokai (Laid-open) No. 54-59936 can be effectively used, where an ink under an action of thermal energy undergoes rapid volumic expansion and is discharged from the nozzle by the force exerted by the change of the state.

Any of various ink jet recording processes as described above can be used to form image patterns such as letters, figures, etc. of colored ink composition on the surface of cloth having the specific composition as described above. In the present method, the ink dots deposited on the cloth can be rapidly absorbed and maintained in the ink acceptor on the cloth before excessive spreading, and thus patterns can be formed, as described above and the fixation efficiency of the dye is also high in the dye-fixing step. The state similar to a dry state can be obtained within 3 minutes after the printing, and thus the printed cloth can be laid one upon another or wound up immediately.

Thus, a clear and fine image pattern can be formed also through the successive dye-fixing step by heat treatment, etc. On the other hand, in the case of the conventional cloth, it is difficult to form fine image patterns thereon owing to the spreading of the ink on the cloth due to the use of an ink of low viscosity and hydrophobic cloth.

As described above, an ink composition can be deposited on cloth according to an image signal in the present method, and the dye in the ink composition in that state is merely absorbed and maintained in the ink acceptor on the surface of cloth. Thus, it is preferable to conduct successive dye-fixing treatment by heating, etc. The dye-fixing treatment depends on the species of dye and cloth used, but can be appropriately selected from steaming with overheated steam, heating with warm or hot water, dry heating, soaping with an aqueous surfactant solution, etc. By the dye-fixing treatment, the dye in the ink acceptor is thoroughly fixed to the fibers of cloth, and the water-soluble ink acceptor is removed by water washing in the soaping treatment, etc., and the printed cloth of distinguished quality can be obtained.

In the present invention, as described above, preparation of expensive print plates as in the conventional, ordinary textile printing is rendered unnecessary in the textile printing, and the patterns to be printed can be very simply prepared and adjusted by a computer. Thus, the present invention can rapidly correspond to a change in fashion tendency at any time without requiring any expensive plate as in the prior art. That is, the present invention can assure enough profit even in the production on a small scale without any production on a large scale as in the prior art. Furthermore, the present invention is applicable, with advantages, not only to the industrial scale textile printing, but also to home hobby textile printing.

The present invention will be described in detail below, referring to Examples, where parts and % are by weight.

INK PREPARATION EXAMPLE 1A

| | |
|---|---|
| Direct dye (C.I. Direct Blue 291) | 5 parts |
| Glycerine | 5 parts |
| Diethyleneglycol | 13 parts |
| Ethylene glycol | 17 parts |
| Water | 65 parts |

All the foregoing components were stirred for about 5 hours, and pH was adjusted to 8.2 with sodium hydroxide, and the mixture was filtered through Fluoropore Filter FP-100 (made by Sumitomo Denko K.K., Japan) under pressure, whereby an aqueous ink (A) was obtained.

INK PREPARATION EXAMPLE 2A

| | |
|---|---|
| Acid dye (C.I. Acid Red 263) | 6 parts |
| Polyethyleneglycol 300 | 10 parts |
| Diethyleneglycol | 20 parts |
| Anionic surfactant (Demol N, by Kao Soap Co., Ltd., Japan) | 0.5 parts |

All the foregoing components were stirred for about 3 hours, and the mixture was filtered through Fluoropore Filter FB-100 (made by Sumitomo Denko K.K., Japan) under pressure, whereby an aqueous ink (B) was obtained.

INK PREPARATION EXAMPLE 3A

| | |
|---|---|
| Reactive dye (C.I. Reactive Orange 53) | 4 parts |
| Nonionic surfactant (Nikkol NP15, made by Nikko Chemicals K.K. Japan) | 0.1 parts |
| Diethyleneglycol | 30 parts |
| Water | 70 parts |

All the foregoing components were treated in the same manner as in Preparation Example 2A, whereby an aqueous ink (C) was obtained.

INK PREPARATION EXAMPLE 4A

| | |
|---|---|
| Basic dye (C.I. Basic Blue 3) | 5 parts |
| Ethanol | 20 parts |
| Polyethyleneglycol 400 | 10 parts |
| Water | 70 parts |

All the foregoing components were treated in the same manner as in Preparation Example 2A, whereby an aqueous ink (D) was obtained.

INK ACCEPTOR PREPARATORY EXAMPLE 1A

| | |
|---|---|
| Tragacanth gum | 0.5 parts |
| Carboxymethylcellulose | 0.1 parts |
| Water | 99.4 parts |

All the foregoing components were stirred at room temperature for 24 hours, and further at 80° C. for 2 hours, and then cooled, whereby a preparatory solution was obtained. Cloth to be printed was treated with the preparatory solution by dipping, and squeezed through rollers, and dried, whereby an ink acceptor layer was formed on the cloth to a thickness of 5 μm.

INK ACCEPTOR PREPARATION EXAMPLES 2A

| | |
|---|---|
| Sodium alginate | 1 part |
| Polyvinylformal | 0.2 parts |
| Water | 98.8 parts |

All the foregoing components were stirred at room temperature for 24 hours, then boiled and cooled, whereby a preparatory solution was obtained. Cloth to be printed was treated with the preparatory solution by dipping, squeezed through rollers, and dried, whereby an ink acceptor layer was formed on the cloth to a thickness of 3 μm.

INK ACCEPTOR PREPARATION EXAMPLE 3A

| | |
|---|---|
| Etherified locust bean gum | 0.2 parts |
| Starch | 0.1 part |
| Polyvinylpyrrolidone | 0.1 part |
| Water | 98 parts |

All the foregoing components were treated in the same manner as in Ink Acceptor Preparation Example 2A, and an ink acceptor layer was formed on the cloth to a thickness of 2 μm.

EXAMPLES 1 to 4

While cloth sheets treated in Ink Acceptor Preparatory Examples 1A to 3A were printed with the inks of Ink Preparatory Examples 1A to 4A. The results are shown in Table 1.

Printing was carried out in a printer utilizing a piezo device (nozzle diameter: 65 μm, PJ-1080A made by Canon Corporation, Japan), and then fixing (dye-fixing) was carried out. To remove the acceptor, the cloth sheets were washed with water, and the grade of printed cloth sheets was visually judged after drying.

COMPARATIVE EXAMPLE 1

Printing was carried out in the same manner as in Examples 1 to 4 without any ink acceptor layer in the combinations shown in Table 1. It was found that the printed cloth sheets were poor in items such as density, color tone, strike-through, and edge sharpness, particularly as compared with the cloth sheets with the ink acceptor layer.

TABLE 1

| Example No. | 1 | 2 | 3 | 4 |
|---|---|---|---|---|
| Ink | Ink A | Ink B | Ink C | Ink D |

TABLE 1-continued

| Example No. | 1 | 2 | 3 | 4 |
|---|---|---|---|---|
| Cloth | cotton 100% | silk 100% | wool 80% polyester 20% | acryl 80% wool 20% |
| | broadcloth | habutae | gaberdine | broadcloth |
| Ink acceptor | Prep. Ex. 1A | Prep. Ex. 2A | Prep. Ex. 3A | Prep Ex. 4A |
| Color Density* | good | good | good | good |
| Color tone* | good | good | good | good |
| Color eveness* | good | good | good | somewhat good |
| Strike-through* | Substantially none | Substantially none | Substantially none | Substantially none |
| Edge sharpness | good | good | good | good |
| Overall evaluation | good | good | good | good |

*Each judgement was made from all-over print (about 2 × 2 $cm^2$) and line print (about 1 mm wide and about 20 cm long) made on the cloth by a printer.

INK PREPARATION EXAMPLE 1B

| | |
|---|---|
| Disperse dye (C.I. Disperse Blue 187) | 5 parts |
| Anionic surfactant (Dispersant) (Demol N, made by Kao Soap Co., Ltd., Japan) | 4 parts |
| Ethyleneglycol | 15 parts |
| Diethyleneglycol | 13 parts |
| Water | 65 parts |

All the foregoing components were dispersed in an alumina ball mill for about 36 hours, and pH was adjusted to 8.3 with sodium hydroxide. Then, the mixture was dispersed with an alumina ball mill for 3 hours, and then filtered through Fluoropore Filter FP-1000 (made by Sumitomo Denko K.K., Japan) to remove coarse particles having particle sizes of more than 10 μm, whereby an aqueous ink (E) of the present invention was prepared.

INK PREPARATORY EXAMPLE 2B

| | |
|---|---|
| Disperse dye (C.I. Disperse Yellow 78) | 5 parts |
| Anionic surfactant (Ionet D-2, made by Sanyo Kasei Kogyo K.K., Japan) | 4 parts |
| Diethyleneglycol | 15 parts |
| Triethyleneglycol monoethyl ether | 10 parts |
| Water | 70 parts |

All the foregoing components were dispersed with an alumina ball mill for about 36 hours, and pH was adjusted to 7.6 with sodium hydroxide, and then the mixture was further dispersed with a homogenizer for 2 hours. Then, the mixture was centrifuged to remove coarse particles, whereby an aqueous ink (F) was obtained.

INK PREPARATORY EXAMPLE 3B

| | |
|---|---|
| Disperse dye (C.I. Disperse Red 11) | 4 parts |
| Anionic surfactant (Nikkol OTP-100s, made by Nikko Chemicals, K.K., Japan) | 0.5 parts |
| Anionic surfactant (Demol C, made by Kao Soap Co., Ltd., Japan) | 1.5 parts |
| Nonionic surfactant (Emulgen 911, made by Kao Soap Co., Ltd., Japan) | 0.2 parts |
| Isopropyl alcohol | 0.5 parts |
| Propyleneglycol | 15 parts |
| Polyethyleneglycol | 5 parts |

-continued

| | |
|---|---|
| Water | 75 parts |

All the foregoing components were dispersed in an alumina ball will for about 40 hours, and pH was adjusted to 7.4 with potassium hydroxide, and then the mixture was further dispersed for two hours. Then, the mixture was filtered through Fluoropore Filter FP-500 (made by Sumitomo Denko K.K., Japan) to remove coarse particles having particle sizes of more than 5 μm, whereby an aqueous ink (G) was obtained.

INK ACCEPTOR PREPARATION EXAMPLE 1B

| | |
|---|---|
| Locust bean gum | 0.2 parts |
| Polyvinylformal | 0.05 parts |
| Water | 99.75 parts |

All the foregoing components were stirred for 24 hours, boiled, and then cooled to obtain a preparatory solution. Cloth sheets to be printed were treated with the preparatory solution by dipping, squeezed through rollers and dried, whereby an ink acceptor was formed on the cloth sheets to a thickness of 10 μm.

INK ACCEPTOR PREPARATION EXAMPLE 2B

| | |
|---|---|
| Sodium alginate | 1 part |
| Carboxymethylcellulose | 0.1 part |
| Polyvinyl acetate | 0.1 part |
| Water | 98.8 parts |

An ink acceptor was formed on cloth sheets to be printed from all the foregoing components in the same manner as in Ink Acceptor Preparation Example 1 B to a thickness of 13 μm.

EXAMPLES 5 to 7

White cloth sheets treated in Ink Acceptor Preparation Examples 1 B and 3B were printed with inks of Ink Preparation Examples 1 B to 3B. Results of printing are shown in Table 2.

Printing was carried out in a printer utilizing a piezo device (nozzle diameter: 65 μm, PJ-1080A, made by Canon K.K., Japan), and then fixing (dye-fixing) was carried out. To remove the acceptor, the cloth sheets were washed with water, and the grade of printed cloth sheets was visually judged after drying.

COMPARATIVE EXAMPLE 2

Printing was carried out in the same manner as in Example 5 to 7 without any ink acceptor in the combinations shown in Table 2. It was found that the printed cloth sheets were poor in items such as density, color tone, strike-through, and edge sharpness, particularly as compared with the cloth sheets with the ink acceptor.

TABLE 2

| Example No. | 5 | 6 | 7 |
|---|---|---|---|
| Ink | Ink E | Ink F | Ink G |
| Cloth | polyester 100% geogette | acetate 100% broadcloth | polyester 65% cotton 35% broadcloth |
| Ink acceptor | Prep. Ex. 1B | Prep. Ex. 2B | Prep. Ex. 1B |
| Color Density* | good | good | good |
| Color tone* | good | good | good |
| Color eveness* | good | good | good |
| Strike-through* | none | none | none |
| Edge sharpness* | somewhat good | good | good |
| Overall evaluation | good | good | good |

*Each judgement was made from all-over print (about 2 × $cm^2$) and line print (about 1 mm wide and about 20 cm long) made on the cloth by a printer.

INK ACCEPTOR PREPARATION EXAMPLES 1C to 6C

In Preparation Examples 1C to 3C shown in Table 3, all the components were stirred at room temperature for 24 hours, further stirred at 80° C. for 2 hours and then cooled to prepare preparatory solutions. Cloth sheets to be printed were treated with the thus prepared preparatory solution by dipping, squeezed through rollers and dried to form ink acceptors on the cloth sheets to be printed.

In Preparation Examples 4C to 6C, all the components shown in Table 3 were stirred at room temperature for 24 hours, then boiled, and cooled to prepare preparatory solutions. Cloth sheets to be printed were treated with the thus prepared preparatory solutions by dipping, squeezed through rollers and dried to form ink acceptors on the cloth sheets to be prepared.

EXAMPLES 8 to 13

White cloth sheets treated in Ink Acceptor Preparation Examples 1 C to 6C were printed with the inks of Ink Preparatory Examples 1 A to 2A. Results of printing are shown in Table 4.

Printing was carried out in a printer utilizing a piezo device (nozzle diameter: 65 μm, PJ-1080A, made by Canon K.K., Japan), and then fixing (dye-fixing) was carried out. To remove the acceptor, the cloth sheets, were washed with water, and the quality of the print of the cloth sheets was visually judged after drying.

TABLE 3

| | Ink Acceptor Preparation Ex. No. | | |
|---|---|---|---|
| | 1C | 2C | 3C |
| Tragacanth gum | 0.01 parts | 0.5 parts | 1.5 parts |
| Carboxymethyl-cellulose | 0.002 parts | 0.1 parts | 0.3 parts |
| Water | 99.988 parts | 99.4 parts | 98.2 parts |
| | 4C | 5C | 6C |
| Sodium alginate | 0.02 parts | 1 part | 3 parts |
| Polyvinylformal | 0.004 parts | 0.2 parts | 0.6 parts |
| Water | 99.976 parts | 98.8 parts | 96.4 parts |

TABLE 4

| Example No. | 8 | 9 | 10 |
|---|---|---|---|
| Ink | Ink A | Ink A | Ink A |
| Cloth | cotton 100% broadcloth | cotton 100% broadcloth | cotton 100% broadcloth |
| Ink Acceptor | Prep. Ex. 1C | Prep. Ex. 2C | Prep. Ex. 3C |
| Thickness of acceptor (μm)* | 0.5 | 20 | 30 |
| Color Density** | good | good | somewhat good |
| Color tone** | somewhat good | good | good |
| Color eveness** | substantially none | good | substantially none |
| Pass-to-back** | Yes | sub- | none |

TABLE 4-continued

| | | | |
|---|---|---|---|
| | | stantially none | |
| Edge sharpness* | good | good | somewhat good |
| Overall evaluation | good | good | good |
| Example No. | 11 | 12 | 13 |
| Ink | Ink B | Ink B | Ink B |
| Cloth | silk 100% habutae | silk 100% habutae | silk 100% habutae |
| Ink Acceptor | Prep. Ex. 4C | Prep. Ex. 5C | Prep. Ex. 6C |
| Thickness of acceptor (μm)* | 1 | 18 | 25 |
| Color Density** | good | good | somewhat good |
| Color tone** | good | good | good |
| Color eveness** | good | good | substantially none |
| Pass-to-back** | substantially none | substantially none | substantially none |
| Edge sharpness** | good | good | good |
| Overall evaluation | good | good | good |

*Thickness of acceptor was determined by measurement according to the following formula: [(Thickness of 10 cloth sheets with the acceptor) − (thickness of cloth sheets without the acceptor)]/20 The mesurement was made by a new model microthickness meter, Type PBM (made by Toyo Seiki K.K., Japan)

**Each judgement was made from all-over print (about 2 × 2 $cm^2$) and line print (about 1 mm wide and about 20 cm long) made on the cloth by a printer.

What we claim is:

1. In a method for textile printing comprising depositing an aqueous jet-ink containing a dye on a textile fabric by ink jet printing, the improvement comprising coating the textile fabric with an 0.5 to 30 micron thick film of an ink acceptor prior to depositing the aqueous jet-ink on the textile fabric; said ink acceptor comprising a water soluble or hydrophilic natural or synthetic polymer capable of rapidly absorbing the aqueous jet-ink.

2. A method according to claim 1, wherein the dye is a water-soluble dye.

3. A method according to claim 1, wherein the aqueous jet-ink contains the dye at a concentration of 0.1 to 15% by weight.

4. A method according to claim 1, wherein the aqueous jet-ink further contains water and a water-soluble organic solvent.

5. A method according to claim 1, wherein the dye is a disperse dye.

6. A method according to claim 1, wherein the textile fabric comprises synthetic fibers or a mixture of synthetic and natural fibers as a main component.

7. In a method for textile printing comprising depositing an aqueous jet-ink containing a dye on a textile fabric by ink jet printing and fixing the deposited dye on the textile fabric, the improvement comprising coating the textile fabric with an 0.5 to 30 micron film of an ink acceptor prior to depositing the aqueous jet-ink on the textile fabric; said ink acceptor comprising a water soluble or hydrophilic natural or synthetic polymer capable of rapidly absorbing the aqueous jet ink.

8. A method according to claim 7, wherein the dye is a water-soluble dye.

9. A method according to claim 7, wherein the aqueous jet-ink contains the dye at a concentration of 0.1 to 15% by weight.

10. A method according to claim 7, wherein the aqueous jet-ink further contains water and a water-soluble organic solvent.

11. A method according to claim 7, wherein the dye is a disperse dye.

12. A method according to claim 7, wherein the textile fabric comprises synthetic fibers or a mixture of synthetic and natural fibers as a main component.

13. In a method for textile printing comprising depositing an aqueous jet-ink containing a dye on a textile fabric by ink jet printing and fixing the deposited dye on the textile fabric, the improvement comprising coating the textile fabric with an 0.5 to 30 micron thick film of an ink acceptor prior to depositing the aqueous jet-ink on the textile fabric, and removing the ink acceptor after fixing the deposited dye on the textile fabric; said ink acceptor comprising a water soluble or hydrophilic natural or synthetic polymer capable of rapidly absorbing the aqueous jet ink.

14. A method according to claim 13, wherein the aqueous jet-ink contains the dye at a concentration of 0.1 to 15% by weight.

15. A method according to claim 13, wherein the aqueous jet-ink further contains water and a water-soluble organic solvent.

* * * * *

UNITED STATES PATENT AND TRADEMARK OFFICE

CERTIFICATE OF CORRECTION

PATENT NO. : 4,702,742

DATED : October 27, 1987

INVENTOR(S) : Kazuo Iwata et al.

It is certified that error appears in the above-identified patent and that said Letters Patent is hereby corrected as shown below:

COLUMN 2

Line 28, "encntered when an" should read --encountered when using an--.
Line 36, "flour rice" should read --flour, rice--.
Line 45, "last" should read --least--.
Line 50, "latex polyvinylformal," should read --latex, polyvinylformal,--.
Line 57, "the" should be deleted.
Line 57, "treating cloth" should read --treating the cloth--.
Line 61, "arns" should read --yarns--.

COLUMN 3

Line 3, "30 m," should read --30 μm,--.
Line 5, "an" should read --and--.
Line 7, "patern" should read --pattern--.
Line 18, "pinting" should read --printing--.
Line 31, "or" should read --for--.

UNITED STATES PATENT AND TRADEMARK OFFICE

CERTIFICATE OF CORRECTION

PATENT NO. : 4,702,742

DATED : October 27, 1987

INVENTOR(S) : Kazuo Iwata et al.

It is certified that error appears in the above-identified patent and that said Letters Patent is hereby corrected as shown below:

COLUMN 3

Line 37, "loww" should read --low--.
Line 45, "has" should read --have--.
Line 46, "copletely" should read --completely--.
Line 55, "Particulrly" should read --Particularly--.

COLUMN 4

Line 6, "111," should read --121,--.
Line 7, "1 25," should read --125,--.
Line 7, "Kaycelon" should read --Kayacelon--.
Line 9, "ellow" should read --Yellow--.
Line 11, "64." should read --64,--.
Line 13, "Reactve" should read --Reactive--.
Line 17, "86." should read --86,--.
Line 20, "24 26," should read --24, 26,--.
Line 23, ";5," should read --75,--.
Line 25, "5,8," should read --5, 8,--.
Line 29, "Japa)." should read --Japan).--.

UNITED STATES PATENT AND TRADEMARK OFFICE

CERTIFICATE OF CORRECTION

PATENT NO. : 4,702,742

DATED : October 27, 1987

INVENTOR(S) : Kazuo Iwata et al.

It is certified that error appears in the above-identified patent and that said Letters Patent is hereby corrected as shown below:

COLUMN 4

Line 48, "19." should read --19,--.
Line 50, "etc. acid" should read --etc., acid--.
Line 64, "9," should read --39,--.
Line 66, "69, 116, 117, 120," should read --69, 71, 75, 77, 78, 85, 89, 92, 93, 95, 96, 105, 109, 116, 117, 120,--.

COLUMN 5

Line 11, "258 288," should read --258, 288,--.
Line 14, "148 149," should read --148, 149,--.
Line 15, "201 205," should read --201, 205,--.
Line 15, "268" should read --268,--.
Line 18, "or" should read --of--.
Line 19, "ther" should read --other--.
Line 23, "dies," should read --dyes,--.
Line 29, "water," should read --water--.

UNITED STATES PATENT AND TRADEMARK OFFICE

CERTIFICATE OF CORRECTION

PATENT NO. : 4,702,742

DATED : October 27, 1987

INVENTOR(S) : Kazuo Iwata et al.

It is certified that error appears in the above-identified patent and that said Letters Patent is hereby corrected as shown below:

COLUMN 5

Line 38, "dioxiane," should read --dioxane,--.
Line 39, "glycol polypropylene" should read --glycol, polypropylene--.

COLUMN 6

Line 32, "Beside" should read --Besides--.
Line 46, "deposite" should read --deposit--.
Line 68, "forcely" should read --forcedly--.

COLUMN 7

Line 9, "process," should read --process,"--.

COLUMN 8

Line 38, insert --Water 63.5 parts--.

UNITED STATES PATENT AND TRADEMARK OFFICE

CERTIFICATE OF CORRECTION

PATENT NO. : 4,702,742

DATED : October 27, 1987

INVENTOR(S) : Kazuo Iwata et al.

It is certified that error appears in the above-identified patent and that said Letters Patent is hereby corrected as shown below:

COLUMN 9

Line 17, "EXAMPLES" should read --EXAMPLE--.
Line 46, "While" should read --White--.

COLUMN 10

Line 41, "PREPARATORY" should read --PREPARATION--.
Line 47, "monoethyl" should read --monomethyl--.
Line 58, "PREPARATORY" should read --PREPARATION--.

COLUMN 11

Line 6, "will" should read --mill-.
Line 64, "geogette" should read --Georgette--.
Line 64, " broadcloth " should read -- broadcloth --.
Prep. Exh. 1B Prep. Exh. 3B

UNITED STATES PATENT AND TRADEMARK OFFICE

CERTIFICATE OF CORRECTION

PATENT NO. : 4,702,742

DATED : October 27, 1987

INVENTOR(S) : Kazuo Iwata et al.

It is certified that error appears in the above-identified patent and that said Letters Patent is hereby corrected as shown below:

COLUMN 13

Line 27, "mesurement" should read --measurement--.
Line 39, "water soluble" should read --water-soluble--.

COLUMN 14

Line 13, "micron film" should read --micron thick film--.
Line 15, "water solu-" should read --water-solu---.
Line 17, "jet ink." should read --jet-ink.--.
Line 39, "water soluble" should read --water-soluble--.
Line 41, "jet ink." should read --jet-ink--.

Signed and Sealed this

Twenty-third Day of August, 1988

*Attest:*

DONALD J. QUIGG

*Attesting Officer*

*Commissioner of Patents and Trademarks*